US005638901A

United States Patent [19]

Shirley et al.

[11] Patent Number: 5,638,901

[45] Date of Patent: Jun. 17, 1997

[54] SPIRAL STRIP PERFORATING SYSTEM

[75] Inventors: Jay R. Shirley, Crowley; Harrold D. Owen, Fort Worth, both of Tex.

[73] Assignee: Owen Oil Tools, Inc., Fort Worth, Tex.

[21] Appl. No.: 459,509

[22] Filed: Jun. 2, 1995

[51] Int. Cl.[6] ..... E21B 7/00

[52] U.S. Cl. ..... 166/55.1; 166/297; 175/4.6; 138/134

[58] Field of Search ..... 175/4.51, 4.53, 175/4.56, 4.6; 166/55.1, 66, 277, 297; 138/134, 154

[56] References Cited

U.S. PATENT DOCUMENTS

| | | | |
|---|---|---|---|
| 1,793,280 | 2/1931 | Williams | 138/154 |
| 2,927,534 | 3/1960 | Le Bus | 175/4.6 X |
| 2,960,930 | 11/1960 | Bell | 175/4.53 |
| 2,965,031 | 12/1960 | Johns | 166/66 X |
| 4,074,756 | 2/1978 | Cooke | 166/277 X |
| 4,583,602 | 4/1986 | Ayers | 166/55.1 X |
| 4,951,744 | 8/1990 | Rytlewski | 175/4.57 |
| 5,095,999 | 3/1992 | Markel | 175/4.6 |
| 5,241,891 | 9/1993 | Hayes et al. | 175/4.6 |

*Primary Examiner*—Roger J. Schoeppel
*Attorney, Agent, or Firm*—Charles D. Gunter, Jr.; Grady K. Bergen; Mark D. Perdue

[57] ABSTRACT

A perforating gun having an elongated, spiral strip with an outer surface, cylindrical about a longitudinal axis, and a diameter sized for convenient entry and removal from a well. The strip has a series of threaded openings spaced in intervals for mounting capsule explosive charges in a phased relationship between 0 and 360 degrees. The cross-sectional area of the strip around each opening is selected to prevent fragmentation of the carrier upon detonation of the charges. The spiral strip is preferably metallic and forms a helical band with a pitch in a range of 12 to 24 inches. In each threaded opening is an explosive capsule with a hollow cap having at one end a threaded nose for attachment to one of the threaded openings. The cap has an annular, interior thread with a thread run-out of selected width at the other end. The capsule has a hollow body having an open end with exterior threads with a width less than the width of the thread run-out in the cap to permit free spinning of the body in the cap after thread make-up. The closed end of the body has a slot and retainer to receive a detonating cord. The hollow body of the explosive capsule may be freely spun to align the slot and retainer for convenient threading and connection with the detonating cord.

4 Claims, 8 Drawing Sheets

SPIRAL STRIP PERFORATING SYSTEM

CROSS REFERENCE TO RELATED APPLICATION

This application has subject matter in common with the following application of a common assignee: Perforation Gun with Retrievable Mounting Strips, Ser. No. 08/372,393 filed Dec. 8, 1994, now U.S. Pat. No. 5,542,480.

BACKGROUND OF THE INVENTION

1. Field of the Invention

The present invention relates to through tubing perforation guns used to support explosive charges in a borehole to form perforations through which water, petroleum or minerals are produced.

2. Background Information

This invention is an improvement to prior art phased, through tubing, perforating system in that it allows for widely varied phasing (i.e., orientation of multiple directional charges at various angles) while allowing for retrieval of the carrier. Prior art phased capsule perforating systems may be generally classified into three categories: (1) the phased frangible base strip (U.S. Pat. No. 4,951,744); (2) the retrievable base strip with frangible retaining means (U.S. Pat. No. 5,095,999); and (3) the phased expendable link (U.S. Pat. No. 5,241,891).

The disadvantages of the first category (illustrated in FIG. 1 of the drawings) is that the shattered pieces of the base strip are not retrieved from the well leaving a substantial amount of debris. As a result, one cannot determine if all the charges detonated properly. Also, since the base strip shatters after firing the gun, the strip must be brittle and thereby could break when it is not desirable (e.g. upon conveying in the well).

The disadvantage of the second category (illustrated in FIG. 2 of the drawings) is that the base strip is composed of a heavy gauge steel bar that limits possible phasing (normally +45 degrees, −45 degrees) and that distorts (when the shaped charges are fired) to make retrieval difficult. Also, since only a relatively weak breakable clip retains the capsule charge to the base strip, it may break when it is undesirable (e.g. upon conveying into the well). The advantage of this system is that it permits some simple phasing (two rows at +/−45 degrees typically), and the strip is rugged and retrievable.

The disadvantages of the third category (illustrated in FIG. 3 of the drawings) are that more debris is left in the well and that the system is weak (the pins and links often break when they hit obstructions in the tubing), resulting in use only for simple perforating operations. The main advantage of the third category is that very flexible phasing is possible. This high degree of phasing of the capsules is significant to well productivity in many formation types.

The above-mentioned co-pending application discloses a perforating gun carrier with a slotted configuration and interior dimensions to enable capsule orientation at selected phases between 0 and 360 degrees. The carrier has a frangible seam that fractures upon detonation to form two retrievable strips, each supported by the conveyance sub for retrieval. The seam is a narrow bridge, formed by slotting the carrier partially, with a cross-sectional area that shatters upon detonation of the shaped charges. The remaining cross-sectional area and strength of each strip is sufficient to assure retrieval after detonation. The strips are preferably nonplanar, arcuate or a segment of a circle in cross section.

When the capsule charges are arrayed around many phases, by attaching both front and rear portions of the capsule charges to the nonfrangible regions of the carrier, detonating cords are used for detonation.

SUMMARY OF THE INVENTION

The general object of the invention is to provide a gun for well perforating that overcomes the various disadvantages of the prior art devices with a carrier that produces perforations in a wide degree of patterns, including a 360 degree phase relationship, that does not fragment and that is therefore removable from the well.

This object is achieved with a perforating gun having an elongated, spiral strip with an outer surface diameter sized for convenient insertion and removal from a well. The strip has a series of openings spaced in intervals for mounting capsule explosive charges in a phased relationship between 0 and 360 degrees. The cross-sectional area of the strip around each opening is selected to prevent fragmentation of the carrier upon detonation of the charges. The spiral strip is preferably metallic and forms a helical band with a pitch in a range of 12 to 24 inches.

In each opening is an explosive capsule with a hollow cap with a nose for attachment to one of the openings. The cap has an annular, interior thread with a thread run-out of selected width. The explosive capsule has a hollow body having an open end with exterior threads and a width less than the width of the thread run-out in the cap to permit free spinning of the body in the cap after thread makeup for convenient threading and connection with the detonating cord.

The above as well as additional objects, features, and advantages of the invention will become apparent in the following detailed description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 8-A is a cross-sectional view as seen looking along the corresponding lines and arrows of FIG. 8;

FIG. 9-A is an enlarged, fragmentary view taken from FIG. 9.

DETAILED DESCRIPTION OF THE INVENTION

Figure 1:
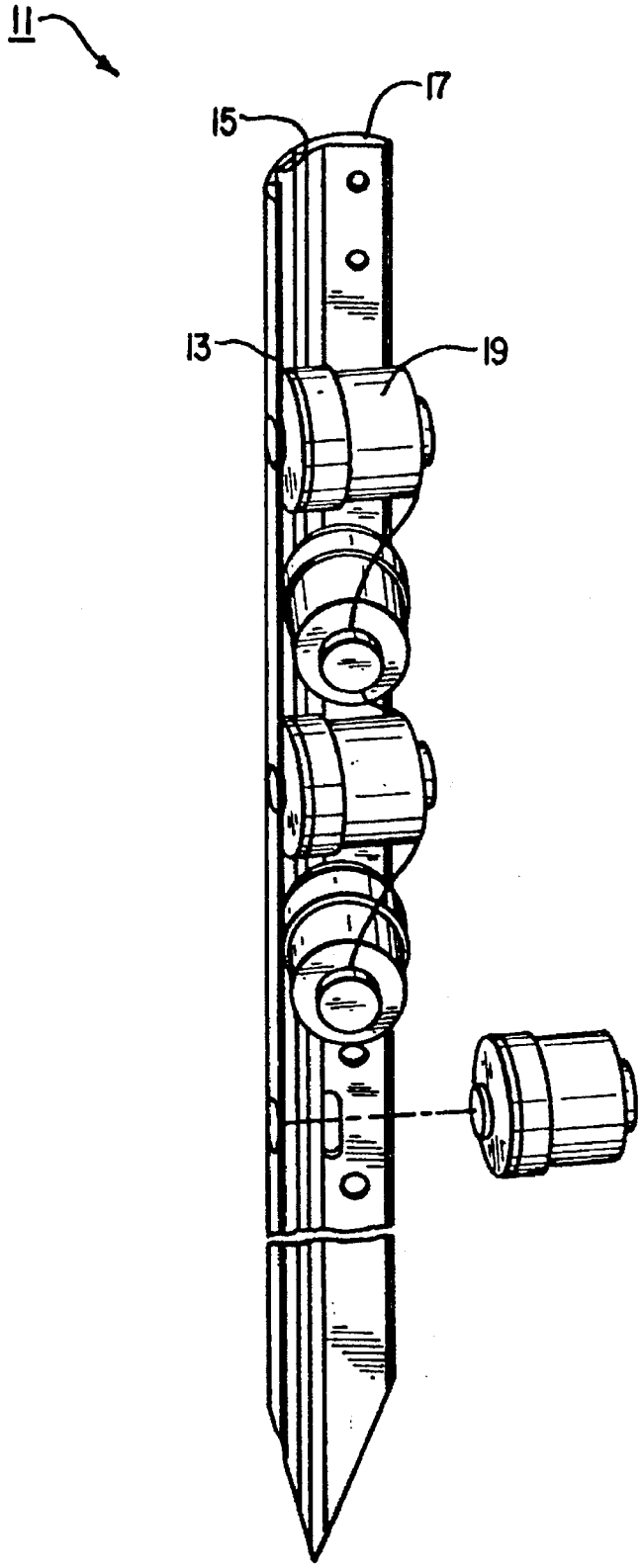
FIG. 1 (PRIOR ART)
FIG. 1 illustrates a prior perforating gun of the type that utilizes a frangible base strip.
Figure 2:
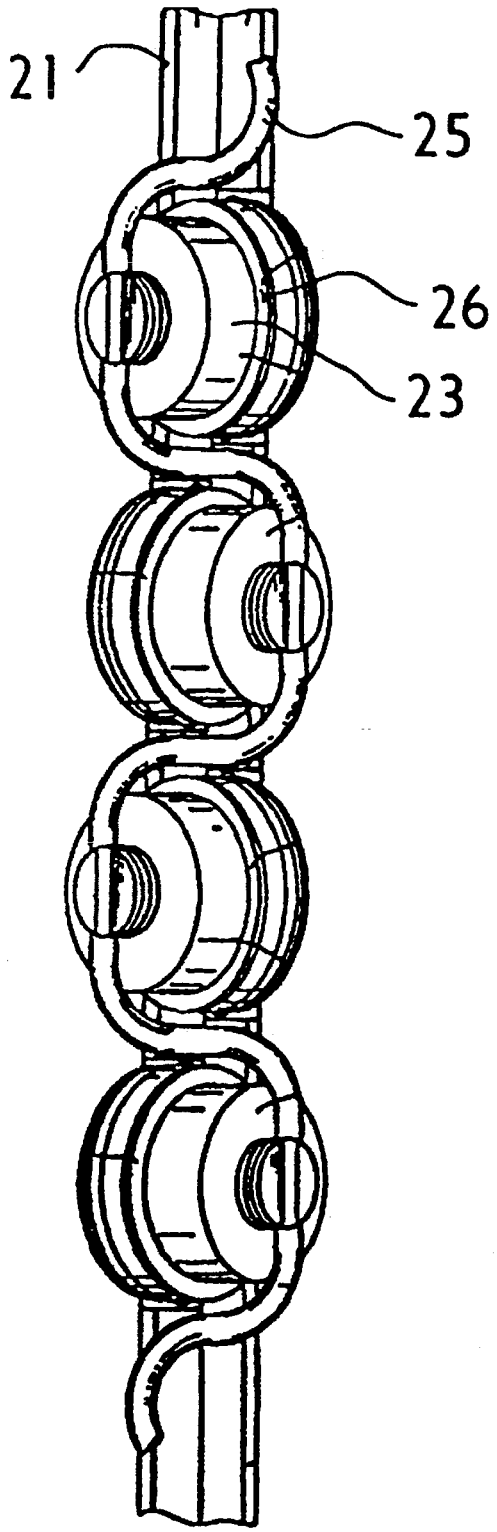
FIG. 2 (PRIOR ART)
FIG. 2 is a prior art perforating gun of the type utilizing a retrievable base strip with frangible retaining means.
Figure 3:
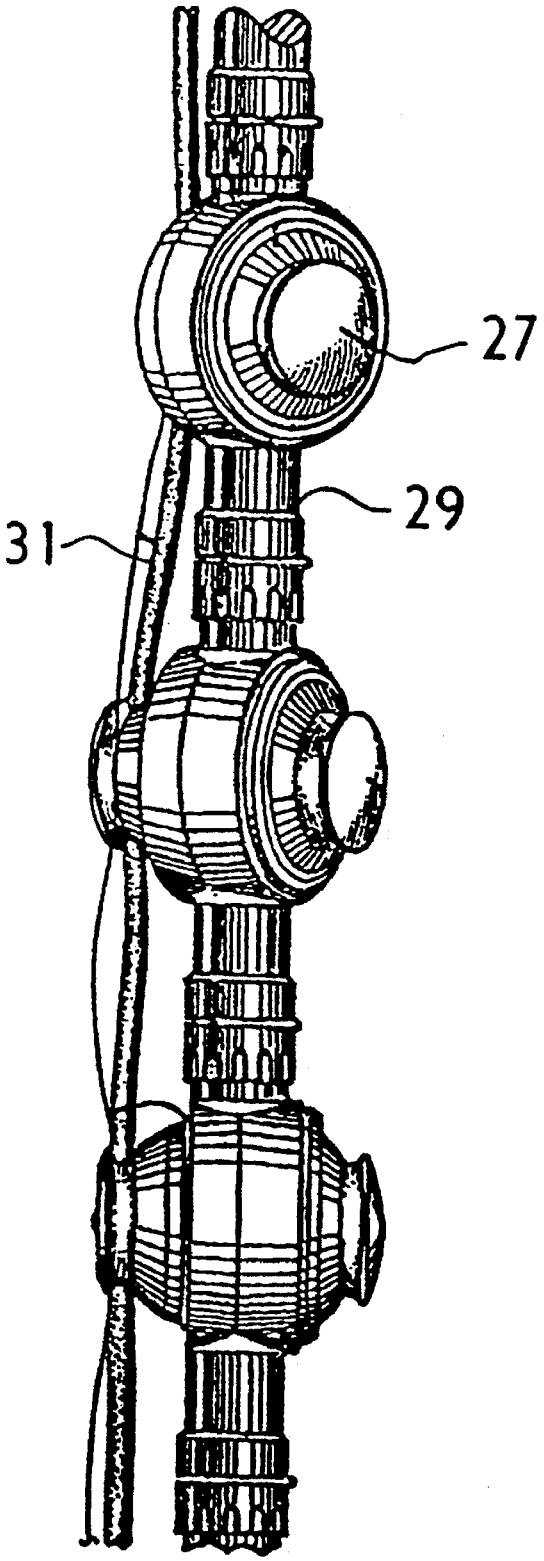
FIG. 3 (PRIOR ART)
FIG. 3 is a prior art perforating gun having multi phased expendable links.

Referring initially to FIGS. 1–3 of the drawings, which illustrate three prior art perforating guns, the perforating gun 11 of FIG. 1 utilizes a frangible base strip 13 having plural surfaces 15, 17 upon which are mounted a plurality of capsule charges 19 oriented at different angles or phases to perforate a well in more than one direction. The base strip 13 is constructed of a material as explained in the specification of U.S. Pat. No. 4,951,744 to shatter into a multitude of very small pieces in response to detonation of the capsule charges, allowing the resulting debris from the base strip to fall ideally below the perforating zone, to prevent obstruction of the flow of oil or gas from the perforated well. The material of the base strip 13 is strong enough to avoid breakage during impact with an obstruction when travelling downward in the borehole.

A retrievable base strip that will not shatter when the charges detonate, and that may be retrieved from the well, is disclosed in U.S. Pat. No. 5,095,999. Here, the charges are retained on the base strip by support rings that will shatter into a multitude of pieces, allowing the charges to fall to the bottom of the well. This configuration of perforating gun is illustrated in FIG. 2 of the drawings and is taken from U.S. Pat. No. 5,095,999. A nonfrangible strip 21 is retrievable from the well after detonation of the capsule charges 23 upon ignition of the detonating cord 25. The capsule charges 23 are retained on the base strip 21 by a plurality of support rings 26 that shatter upon detonation of the capsule charges.

Another prior art perforating gun is shown in U.S. Pat. No. 5,241,891 and in FIG. 3, wherein the explosive charges 27 are mounted on link carriers 29, and are detonated by ignition of the detonating cord 31. This configuration of perforating gun occupies a small diameter similar to prior art guns in the well while enabling multi-phase orientation of the charges and retrieval from a well.

Figure 4:
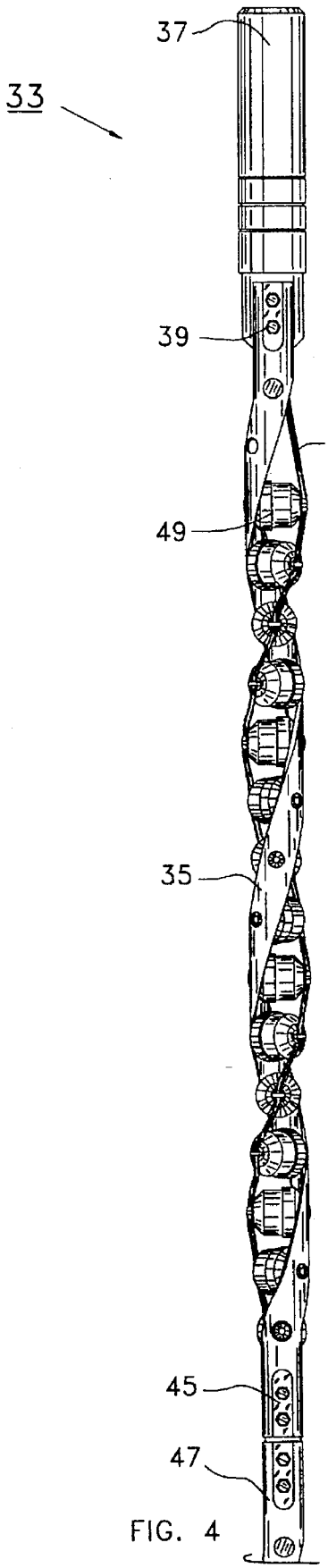
FIG. 4 illustrates the preferred embodiment of the present invention in a frontal view.

Referring now to FIG. 4 of the drawings and the preferred embodiment of the present invention, the numeral 33 designates a perforating gun for well perforating having an elongated, spiraled strip 35 having an outer diameter sized for convenient insertion and removal from a well that contains geological formations that are to be perforated to enhance the production of petroleum or other minerals.

The spiral strip 35 is manufactured by utilizing the capabilities of a multiple axes laser milling machine on Drawn over mandrel (DOM) tubing. The laser mill must have at least the X-axis and rotational capabilities in order to slit the spiral strip. Four (4) strips are manufactured from each full round tube started. The tube is left partially connected until all spiral slits are made over the length of the tube. The partial connection points are later broken apart to yield four (4) separate strips. The threaded holes on the strip are then completed on conventional machine centers.

Figure 5:
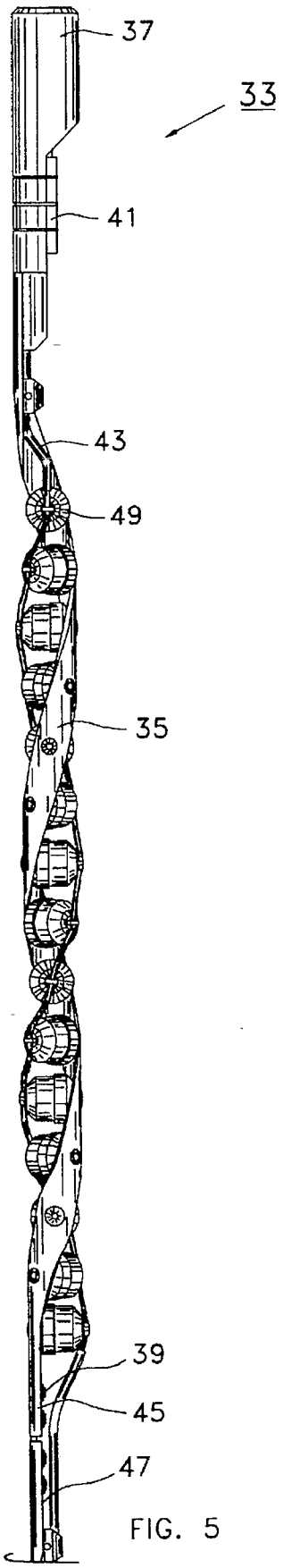
FIG. 5 is a side elevational view of the FIG. 4 embodiment.

The perforating gun 33 has at its upper end a connector 37 for mounting on a conveyance sub (not shown) to raise or lower and position the gun at the selected elevation in the well adjacent to the geological formation to be perforated. The strip 35 is connected to a lower end of connector 47 with a plurality of fasteners 39 that may socket head set screws or the equivalent. Secured to the connector 37 is an electrical means 41 (see FIG. 5) adapted to supply electrical energy to a detonating cord 43.

Figure 8:
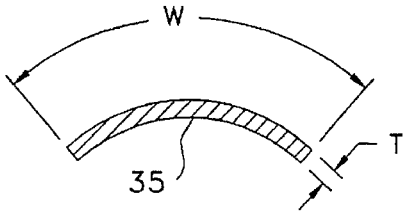
FIG. 8 is a fragmentary, enlarged view of the carrier of the FIG. 4 embodiment to illustrate the mounting means and strip configuration.
Figure 8:
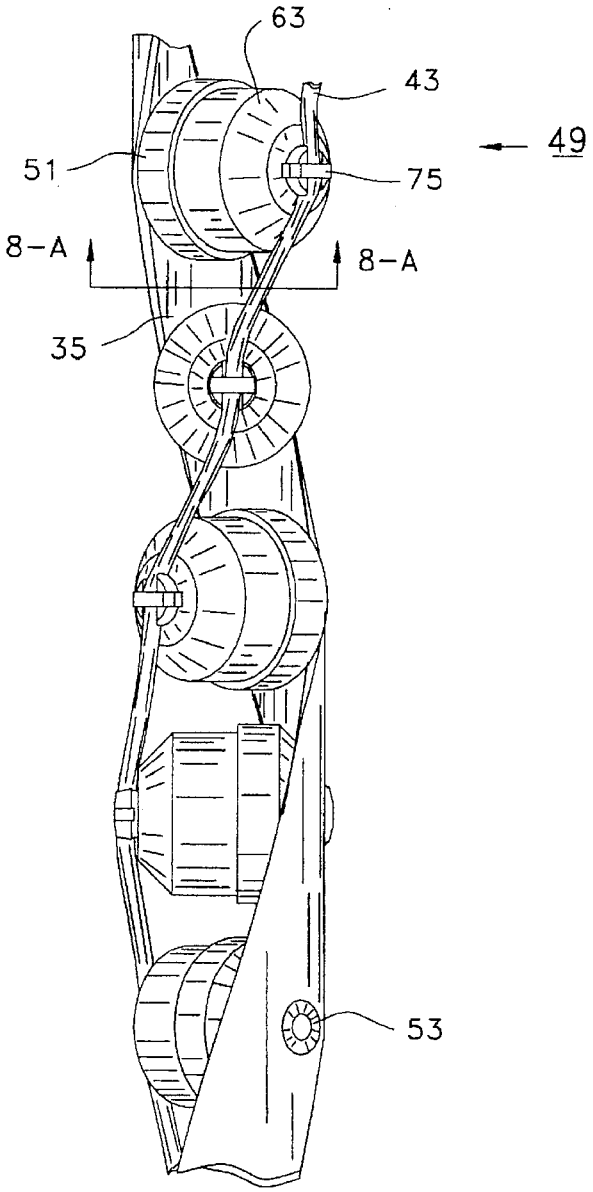

The exterior surface of the strip 35 is cylindrical about a longitudinal axis (not shown) and is formed of a selected metal that forms a helical band with a pitch in a range of 12 to 24 inches. As shown in the cross-sectional view of FIG. 8A, a suitable thickness t for the strip is 0.125 inch and the circumferential width W 1.25 inches.

At the lower end of the strip is connected a strap 45 to which may be secured a second spiraled strip 47. There are a series of openings in the spiraled strip 35 to serve as mounts for a plurality of explosive capsules 49. These openings are spaced in intervals along the length of the spiral strip so that they are arranged in a phase relationship to correspond with the selected perforation pattern in the well.

Figure 9:
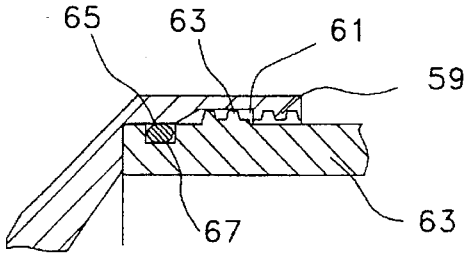
FIG. 9 illustrates one capsule charge of the type used in the preferred embodiment of FIG. 4.
Figure 9:
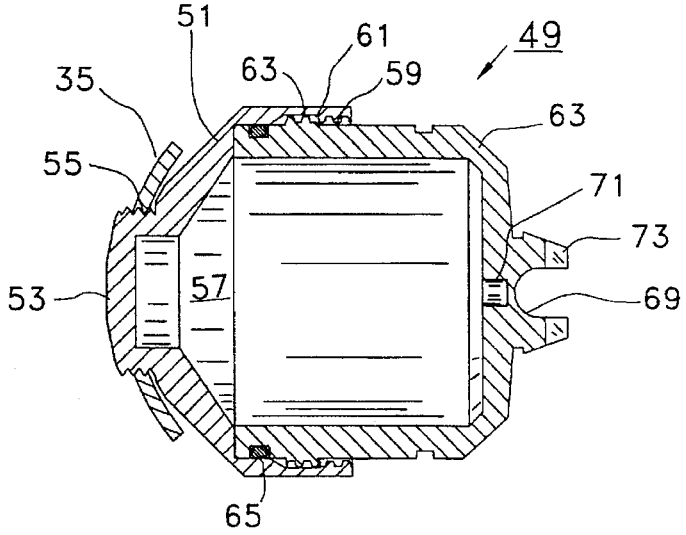

As shown in FIG. 9, each of the explosive capsules 49 has a cap 51 having a threaded nose 53 that engages the threads 55 of the strip 35. The cross-sectional area of the strip around or adjacent each opening is selected to prevent fragmentation of the strip 35 upon detonation of the charge, taking into account the strength of the material used to form the strip, which in the preferred embodiment is a strong, ductal and flexible material such as 1018 steel. The cap 51 is hollow with an interior cavity 57 to receive an explosive charge and terminate in an angular interior thread 59 having a thread runout 61, as may be better seen in the enlarged, fragmentary view of FIG. 9A.

The thread runout 61 is wider than the threads 63 that are formed on the exterior of the open end of a hollow body 64 that partially contains the previously described explosive charge. The open end of the hollow body also has a seal 65 in an annular groove 67 to prevent contamination and degradation of the explosive charge. The opposite end of the hollow body 63 has a slot 69 to receive the detonating cord 43 shown in FIGS. 4 and 5, which is adjacent a heat-sensitive firing pin 71 that will detonate the explosive inside the capsule. A slot 73 receives a retainer clip 75 (see FIG. 8) of conventional configuration to secure the detonating cord in its position adjacent to firing pin 71.

Figure 6:
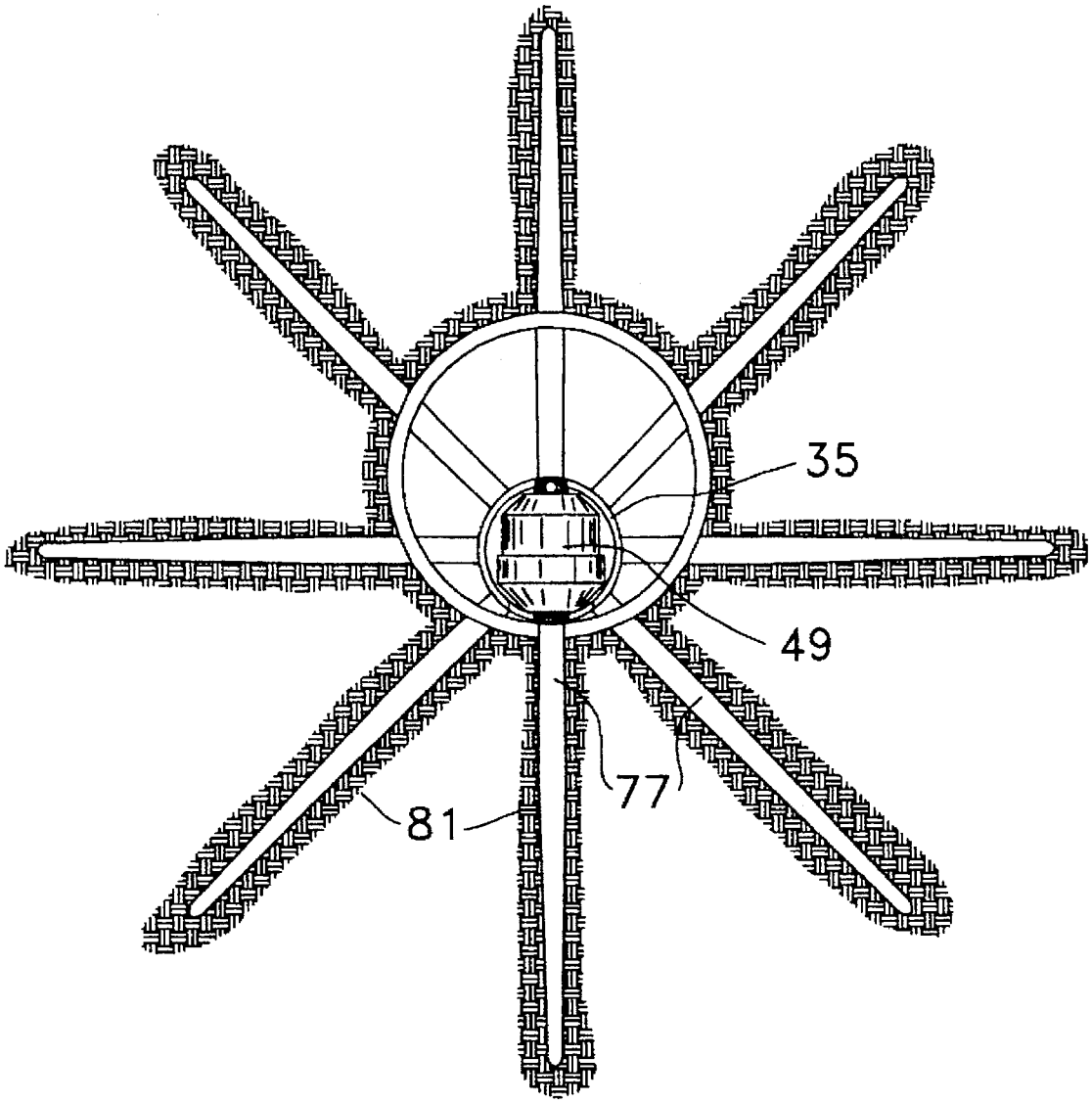
FIG. 6 is a view of the FIG. 4 embodiment shown from the top within a casing to be perforated to illustrate the shaped charge orientations and perforations in the casing and geological formation.
Figure 7:
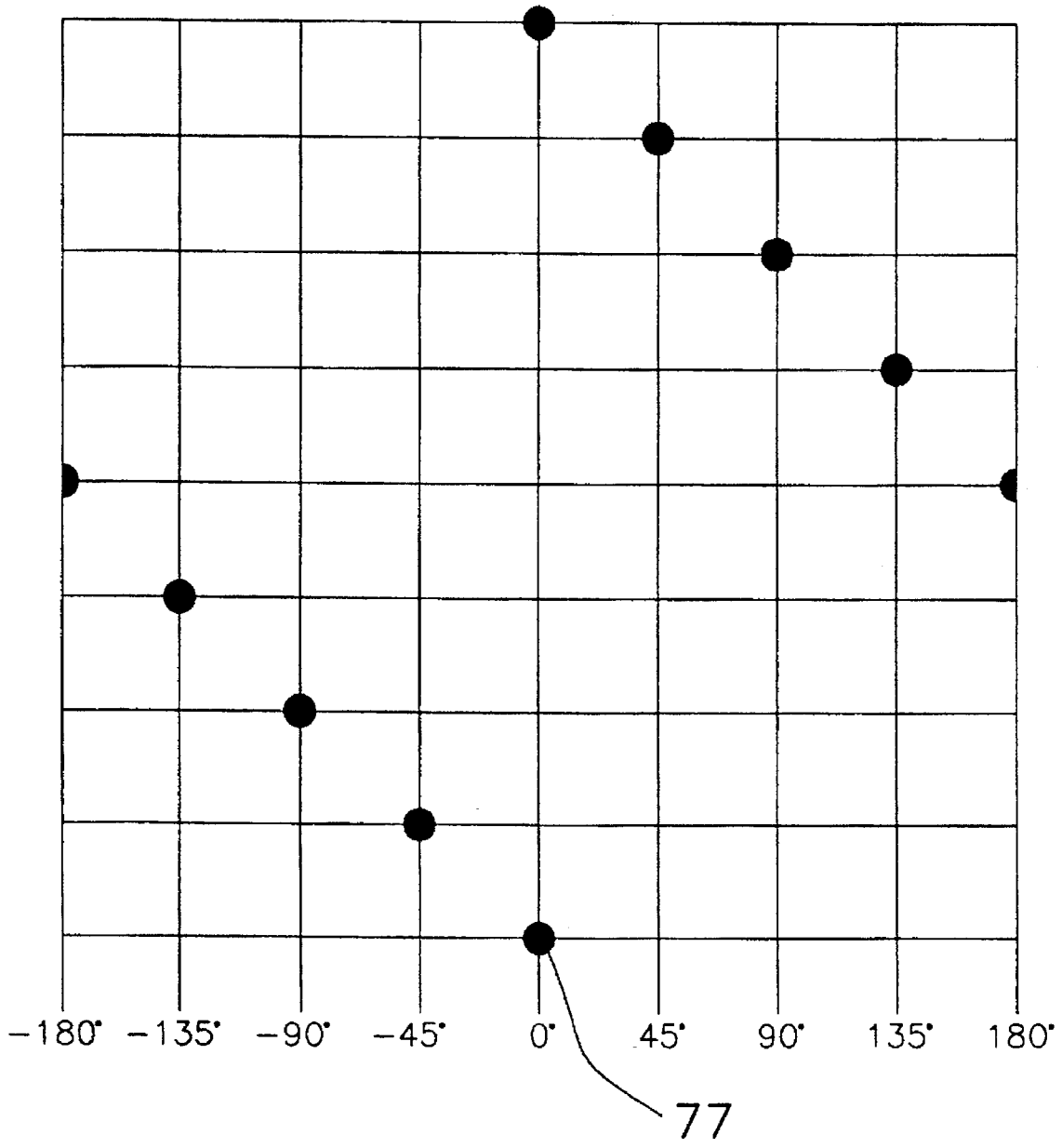
FIG. 7 is a phase diagram showing the phase relationship of the capsule charges in the FIG. 4 embodiment.

It should be apparent from the foregoing that an invention having significant advantages has been provided. The spiral strip 35 can be configured to enable the orientation of explosive capsules in a wide variety of selected patterns, one of which is shown in FIG. 6 in which the strip 35 is used to position the explosive capsule 49 and others like it to form perforation 77 through the metal casing 79 and into the geological formation 81. This pattern has a phase relationship as shown in FIG. 7 wherein the perforation 77 is indicated by the corresponding point at zero degrees. Moreover, the configuration of the spiral strip, when constructed as indicated above, prevents it from fragmenting or major distortion that would prevent its retrieval from a wellbore after the explosive capsules are detonated.

While we have shown our invention in only one of its forms, it is not thus limited but is susceptible to various changes and modifications without departing from the spirit thereof.

We claim:

1. A perforating gun for carrying a plurality of shaped charge explosives connecting by a detonating cord to perforate a section of a well in a selected pattern, comprising:

an elongated, spiraled strip having an outer diameter sized for convenient entry and removal from a well;

a series of openings spaced in intervals along a length of the spiraled strip to serve as mounts for the shaped charge explosives to be arranged in an angular phase relationship to correspond with said selected perforation pattern in the well;

the cross-sectional area of the spiraled strip around each opening being selected to prevent fragmentation of the carrier upon detonation of the charges;

whereby the spiraled strip may be positioned in the well, the explosives detonated to create perforations in the selected pattern and the spiraled strip retrieved from the well;

wherein said openings of the spiraled strip are threaded; and wherein the perforating gun has an explosive capsule charge which comprises:

a cap having a threaded nose for engagement with a threaded opening of said spiraled strip;

the cap being hollow to contain explosive and terminating in an annular, interior thread with a thread run-out of selected width;

a hollow body to contain said explosive and having an open end with exterior threads having a width less than the width of the thread run-out in the cap to permit free spinning of the body in the cap after thread make-up;

a slot and retainer to receive a detonating cord on a closed end of the hollow body;

whereby the hollow body may be freely spun to align said slot and retainer for convenient threading and connection of the detonating cord with the explosive capsule charge.

2. A perforating gun for carrying a plurality of shaped charge explosives connecting by a detonating cord to perforate a section of a well in a selected pattern, comprising:

an elongated, spiraled strip having an exterior surface defining an outer diameter which is cylindrical when viewed from the top along a longitudinal axis the outer diameter being sized for convenient entry and removal from a well;

a series of openings spaced in intervals along a length of the spiraled strip to serve as mounts for the shaped charge explosives to be arranged in an angular phase relationship to correspond with said selected perforation pattern in the well;

at least selected ones of the shaped charge explosives each having a cap with a nose engaged within a selected opening of said spiraled strip and having a hollow body containing an explosive, the hollow bodies of the shaped charge explosives being contained within a minimum diameter of the elongated, spiraled strip;

the cross-sectional area of the spiraled strip around each opening being selected to prevent fragmentation of the carrier upon detonation of the charges;

whereby the spiraled strip may be positioned in the well, the explosives detonated to create perforations in the selected pattern and the spiraled strip retrieved from the well.

3. The invention defined by claim 2 wherein said spiraled strip is metallic and in the form of a helical band twisted at least 360 degrees with a pitch in a range of 12 to 24 inches.

4. The invention defined by claim 2 wherein said openings of the spiraled strip are threaded.

* * * * *